US007249686B1

(12) United States Patent
Aesquivel

(10) Patent No.: US 7,249,686 B1
(45) Date of Patent: Jul. 31, 2007

(54) FOOD SERVING TRAY WITH DRAINING COMPARTMENTS

(76) Inventor: Violeta C Aesquivel, 211 Shattuck Ave. S., Renton, WA (US) 98055

( * ) Notice: Subject to any disclaimer, the term of this patent is extended or adjusted under 35 U.S.C. 154(b) by 0 days.

(21) Appl. No.: 11/161,974

(22) Filed: Aug. 24, 2005

(51) Int. Cl.
*B65D 1/36* (2006.01)
*B65D 57/00* (2006.01)

(52) U.S. Cl. ..... 220/556; 220/553; 206/511; 206/501; 206/514

(58) Field of Classification Search ..... 220/572, 220/513, 507, 556, DIG. 6, 554, 23.91, 501, 220/571, 512, 553; 99/426, 444; 206/508, 206/511, 501, 507, 514; D7/555, 553.1, D7/701
See application file for complete search history.

(56) References Cited

U.S. PATENT DOCUMENTS 1,234,407 A * 7/1917 Stiga ..... 99/380
2,243,625 A * 5/1941 Gettelman ..... 220/627
2,321,676 A * 6/1943 Hennessy ..... 99/425
2,648,456 A * 8/1953 Baxter ..... 220/509
3,727,875 A * 4/1973 Downing ..... 249/121
4,589,546 A * 5/1986 Sunderland ..... 206/315.11
4,662,273 A * 5/1987 Marchioni ..... 99/426
4,827,658 A * 5/1989 Wolniak ..... 43/54.1
5,076,155 A * 12/1991 Golob ..... 99/446
5,197,626 A * 3/1993 Bernstein ..... 220/507
5,429,236 A * 7/1995 Evans ..... 206/386
5,628,405 A * 5/1997 Price et al. ..... 206/561
5,752,433 A * 5/1998 Charlson et al. ..... 99/445
5,791,481 A * 8/1998 Thomas ..... 206/581
5,816,488 A 10/1998 Moeder
6,193,097 B1 * 2/2001 Martin Perianes ..... 220/592.03
6,276,555 B1 * 8/2001 Edwards ..... 220/572
6,360,907 B1 * 3/2002 Przytulla ..... 220/23.91
6,431,059 B1 * 8/2002 Castellani ..... 99/440

* cited by examiner

*Primary Examiner*—Anthony Stashick
*Assistant Examiner*—Chris McKinley
(74) *Attorney, Agent, or Firm*—David L. Tingey

(57) ABSTRACT

A hand-portable serving tray having a compartmented food carrier releasably engaged over a collector tray, the food carrier comprising a plurality of upstanding walls dividing a plurality of close-pack compartments. Within each compartment is at least one hole on a compartment bottom that drains food exudates to the collector tray below. Each compartment bottom is configured to direct fluid to its drain hole.

13 Claims, 8 Drawing Sheets

FOOD SERVING TRAY WITH DRAINING COMPARTMENTS

BACKGROUND

1. Field of the Invention

This invention relates to food carriers, and more specifically to a lightweight portable food server with a plurality of drainable compartments for separating fluids dripping from foodstuffs placed in the compartments, such as oil from fried foods.

2. Prior Art

Certain foods are characteristically intended to be served hot with fluids exuding from them, especially common for fired foods such as oriental egg or spring rolls, pizza pockets, burritos, taquitos, fried potatoes, fish sticks, bread sticks, hot dogs and sausages. Cold foods chilled in cold water will also drain. When these foods, hot and cold, are served in a conventional serving tray, the exudates collect on the tray bottom and the food sits in them, soaking up the exudates. The effect is reduced when elongate foods are assembled generally vertically in the serving tray so the exudates drain down, but the lower portion of the foodstuffs continue to sit in the exudates pooled at the tray bottom. This is undesirable. To reduce the effect, the hot foods may be placed on an absorbing towel to collect a portion of the exudates but the foods cool during the process and are served less hot than preferred. Similarly, the cold foods are wiped with an absorbing towel. Often, for example, rather than allow the hot food to cool, the food is served with the excess exudates.

The object of the present invention is to have a portable server that receives hot or cold foods with exudates directly from the preparation process (i.e., deep frier, baking oven, chilled tub, etc) for uninterrupted delivery to the consumer. It is another object that that food exudates drain from the foods on the server during service but do not pool on the server bottom with the food sitting in it. It is a further object that the server support elongate foodstuffs generally vertically so the exudates drain down to the bottom.

SUMMARY

These objects are achieved in a hand-portable serving tray having a compartmented food carrier engaged over a collector tray. The food carrier has a plurality of upstanding walls dividing a plurality of close-pack compartments for tray efficiency. That is, the compartments are divided by shared walls. In an orthogonal configuration, the carrier presents as a plurality of parallel and spaced apart longitudinal dividers orthogonally intersecting a plurality of parallel and spaced apart transverse dividers together forming the walls of the several compartments. Within each compartment is at least one hole on a compartment bottom that drains exudates to the collector tray below. Legs on the food carrier are received into recesses in collector tray corners to keep the food carrier from moving laterally on the collector tray. The food carrier then simply lifts off for cleaning with the legs separating from the recesses. Each compartment bottom is configured to direct fluid to its drain hole. Typically, the bottom is tapered, or funneled from compartment walls to the one or more holes in the bottom. Equivalently, the bottom may comprise a plurality of channels with channel troughs and ridges, the foodstuffs sitting on the ridges while fluids drained from the foodstuffs flow to the drain hole or holes in the troughs underneath.

Because the serving tray is intended for convey the foodstuffs for immediate use, the upstanding walls are typically of height such that the intended foodstuffs extend out of a compartment and the compartment is uncovered for facile and convenient access.

DETAILED DESCRIPTION OF THE PREFERRED EMBODIMENTS

Figure 1:
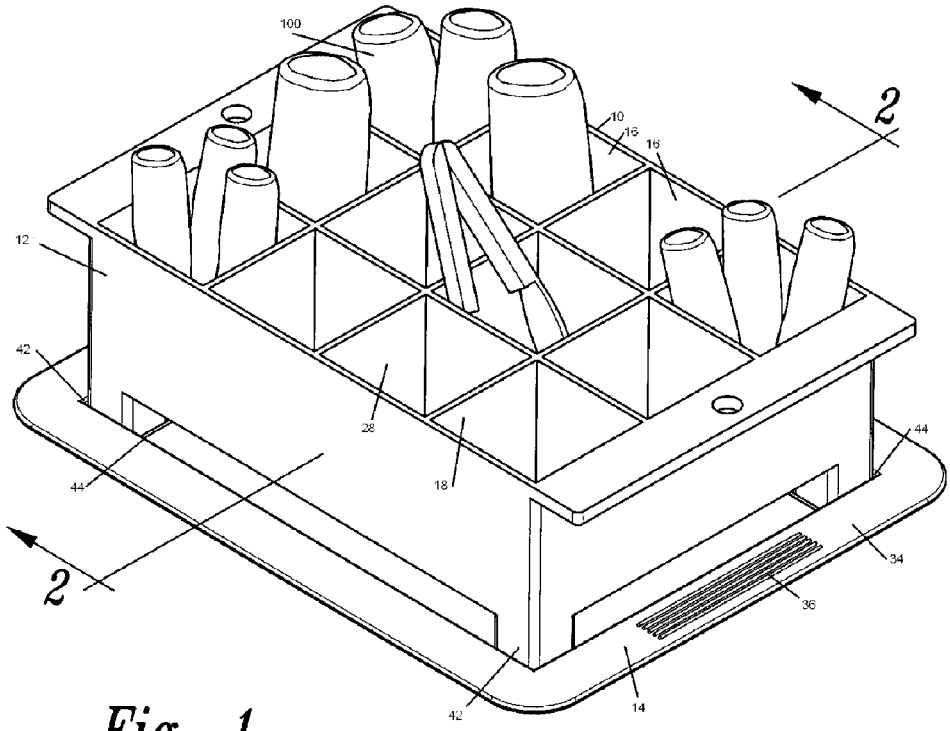
FIG. 1 is a perspective view of the server tray showing the compartmented food carrier engaged on the collector tray.
Figure 2:
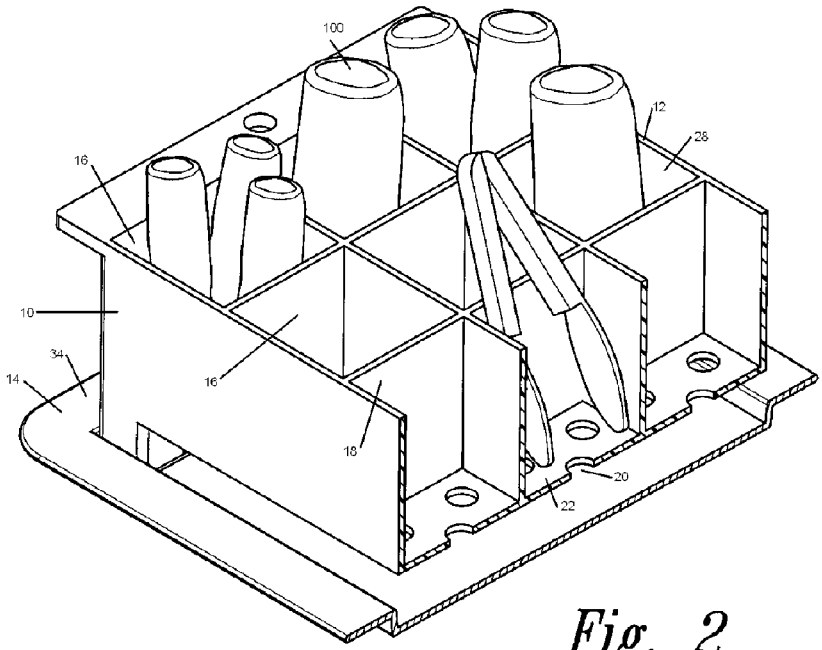
FIG. 2 is a cut-away perspective view of the server tray of FIG. 1 showing a plurality of drain holes on respective food carrier compartment bottoms.
Figure 3:
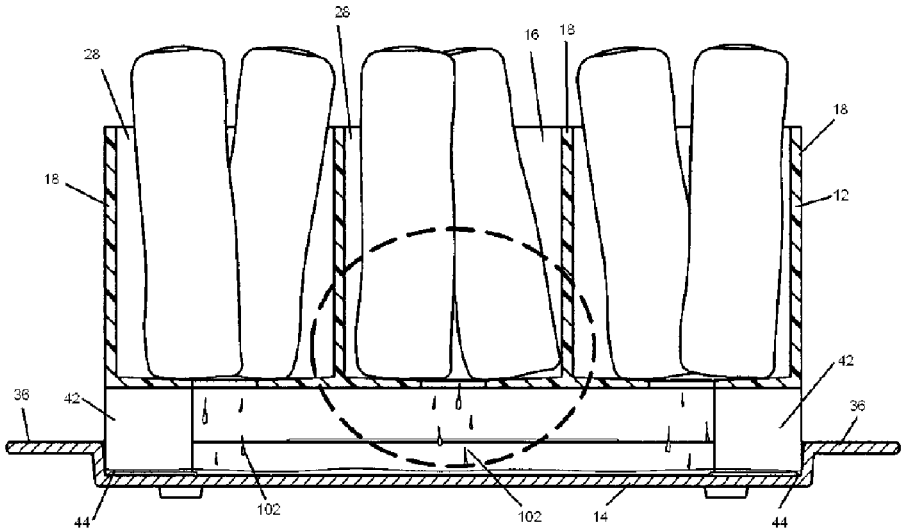
FIG. 3 is a cut-away end view of the server tray of FIG. 2 showing elongate foodstuffs vertical in the several compartments with exudates from the foodstuffs draining through holes in the respective compartments onto the collector tray below.
Figure 4:
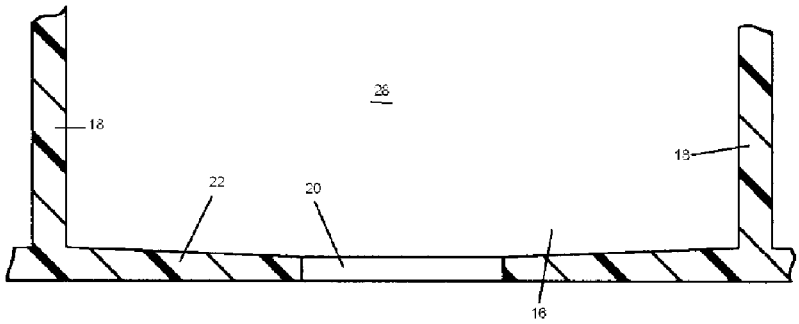
FIG. 4 is a cut-away end view of a portion of a typically compartment showing the compartment bottom funneled, or tapered from compartment walls to a drain hole.
Figure 5:
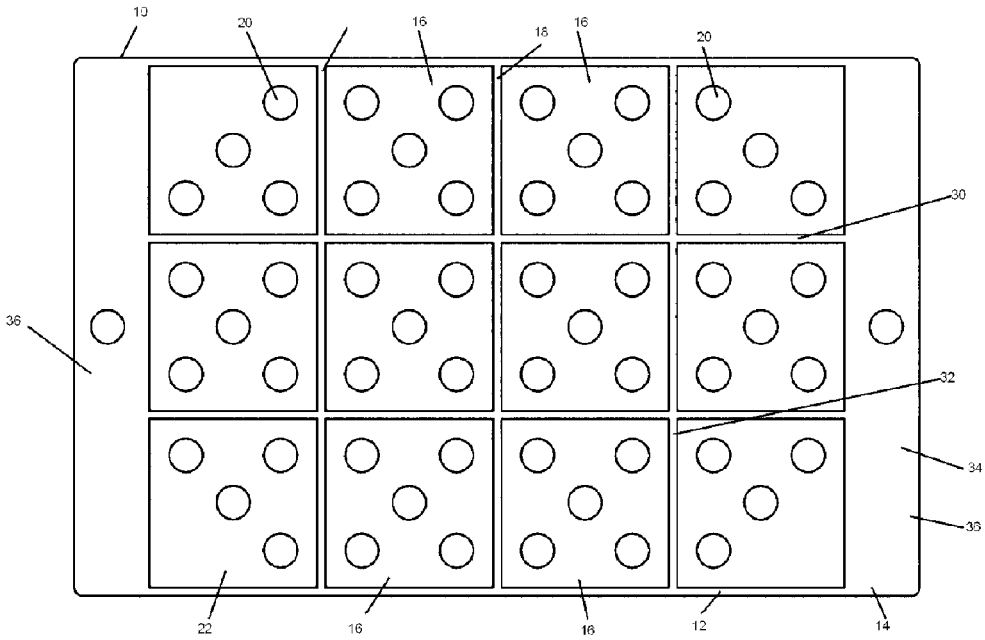
FIG. 5 is a top view of the food carrier.
Figure 6:
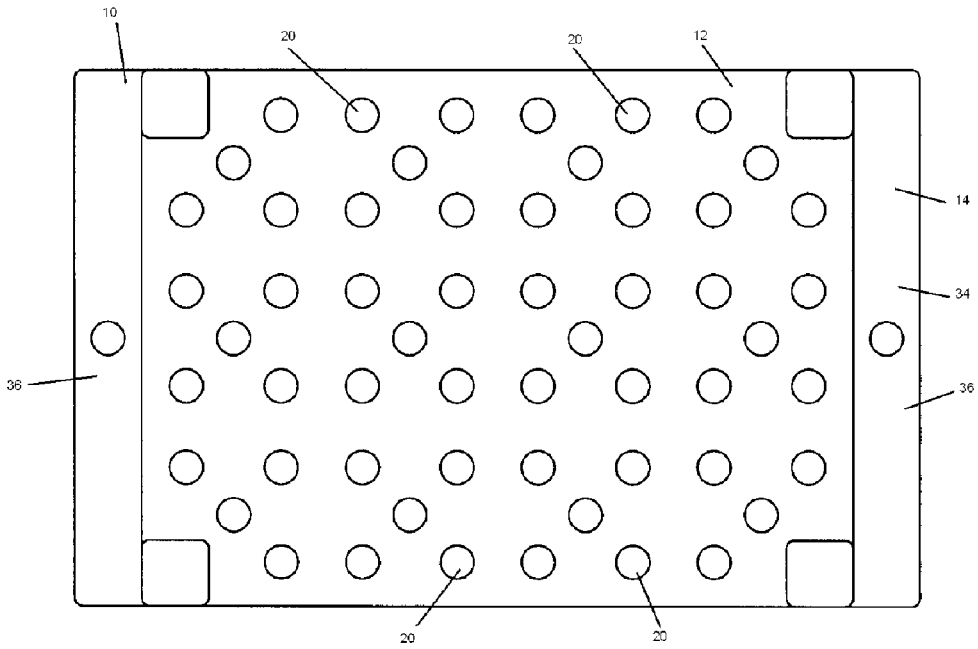
FIG. 6 is a bottom view of the food carrier.
Figure 7:
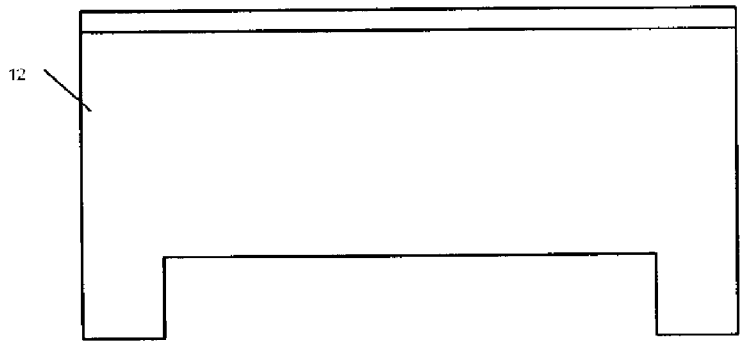
FIG. 7 is an end view of the food carrier.
Figure 8:
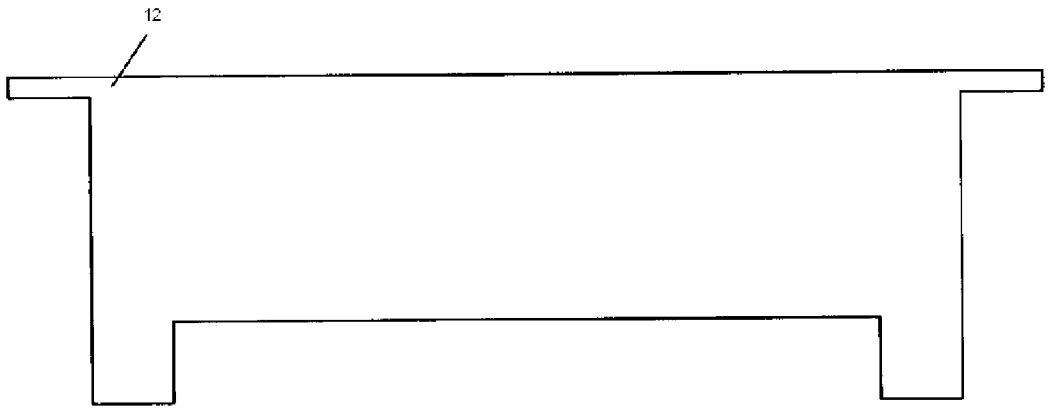
FIG. 8 is a front view of the food carrier.
Figure 9:
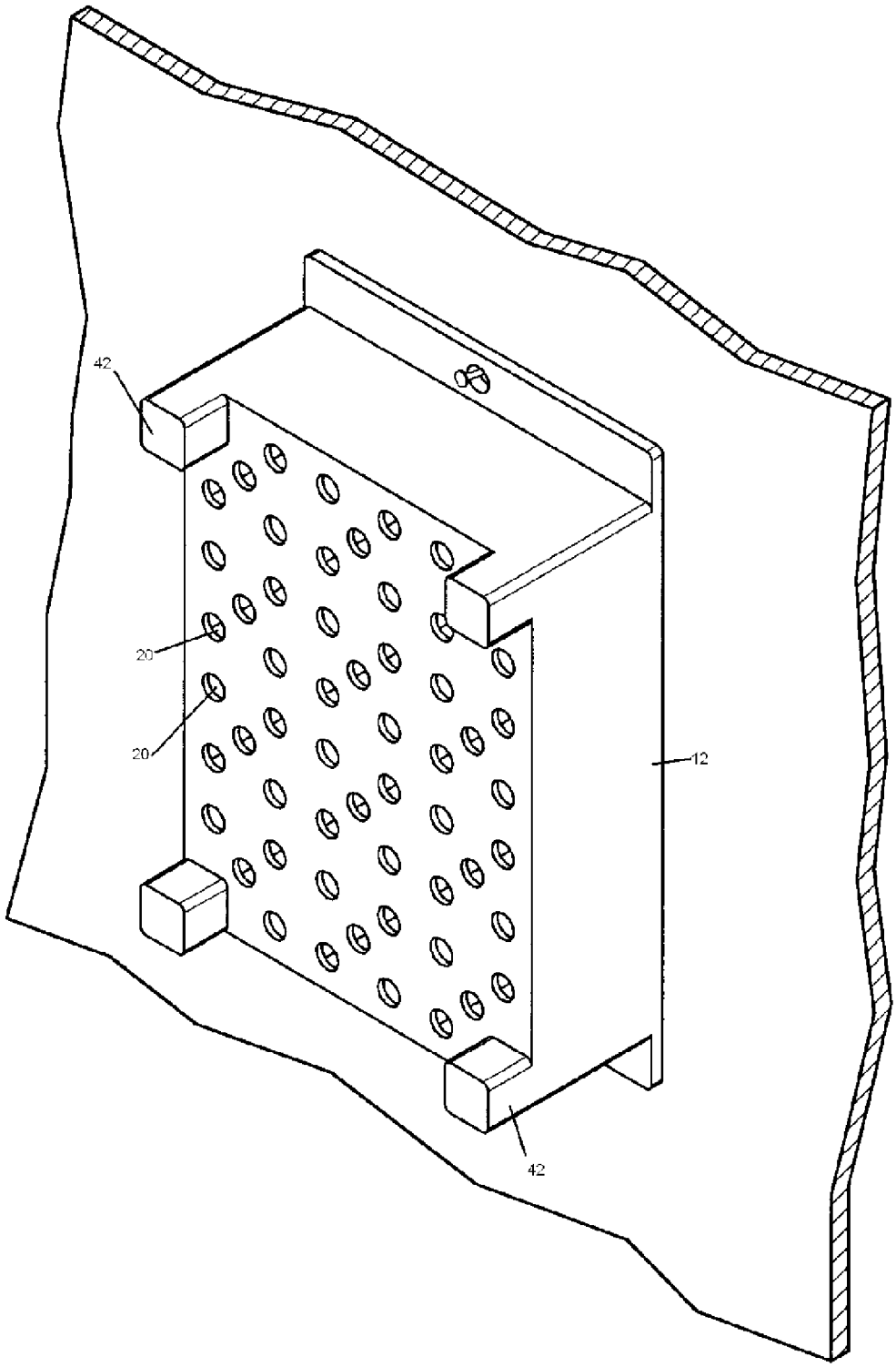
FIG. 9 is bottom perspective view of the food carrier hung in storage from a wall.
Figure 10:
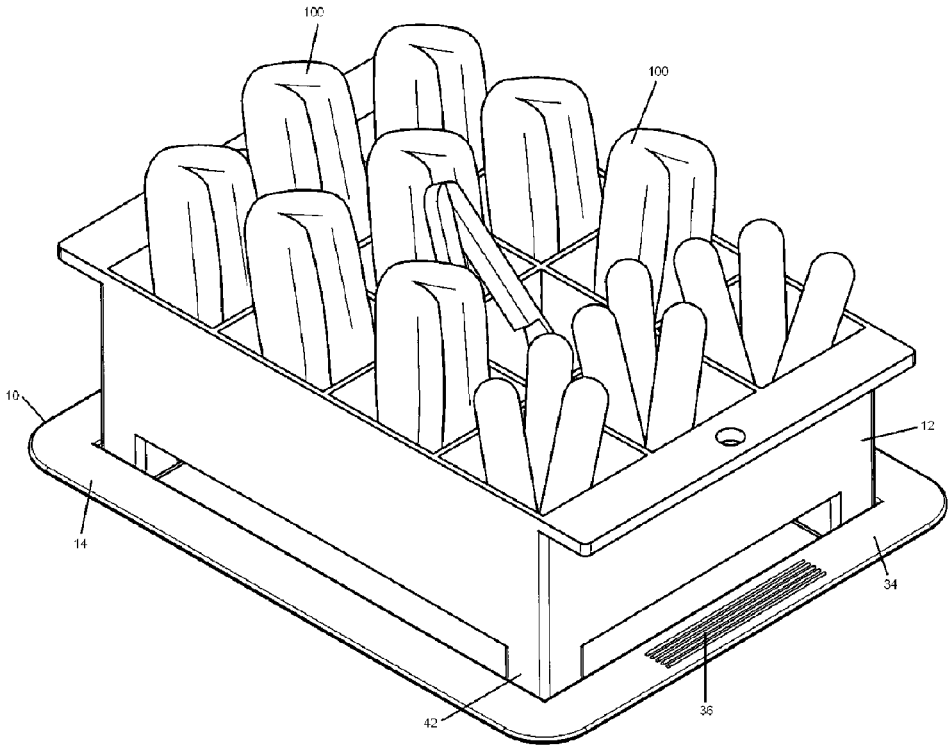
FIG. 10 is a perspective view of the server tray of FIG. 1 shown loaded with various foodstuffs.
Figure 11:
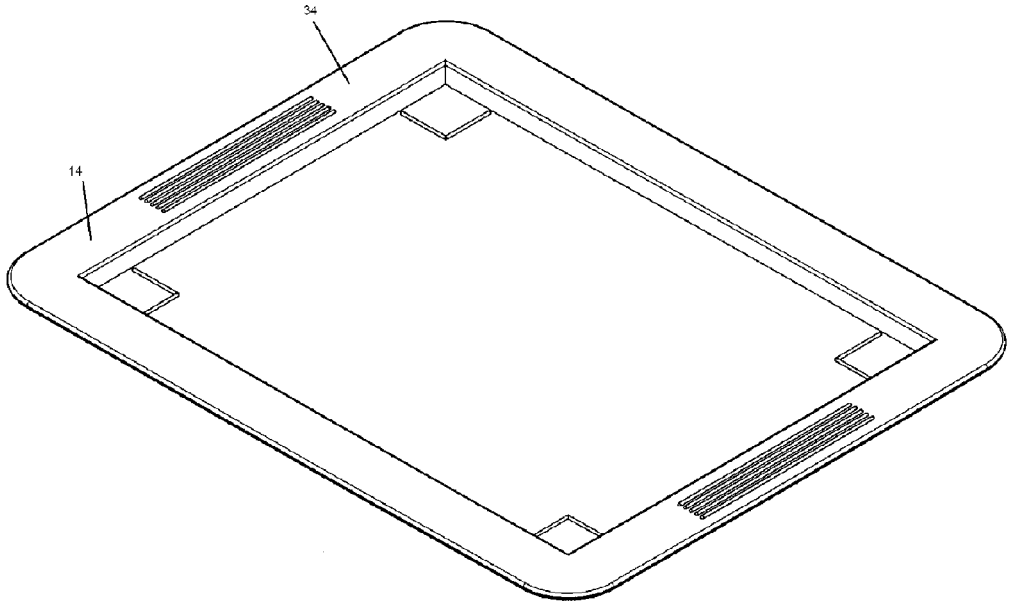
FIG. 11 is a perspective view of the collector tray showing recesses in its corners for receiving food carrier legs.
Figure 12A:
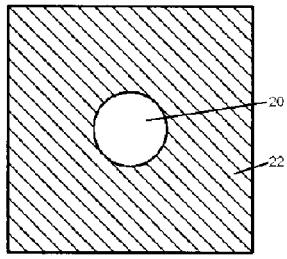
FIGS. 12A through 12F are top views of representative compartment bottoms in various configurations of drain hole patterns.
Figure 12B:
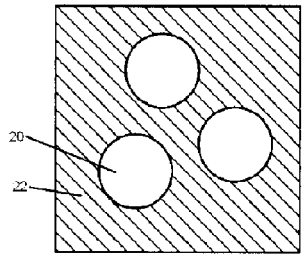
Figure 12C:
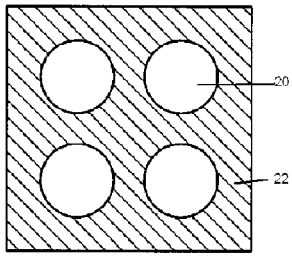
Figure 12D:
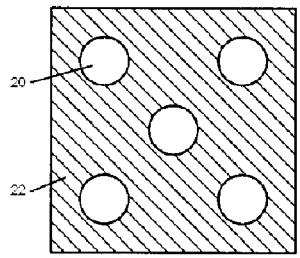
Figure 12E:
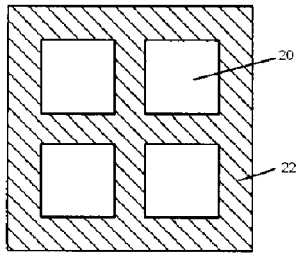
Figure 12F:
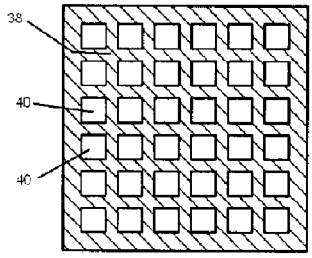
Figure 13:
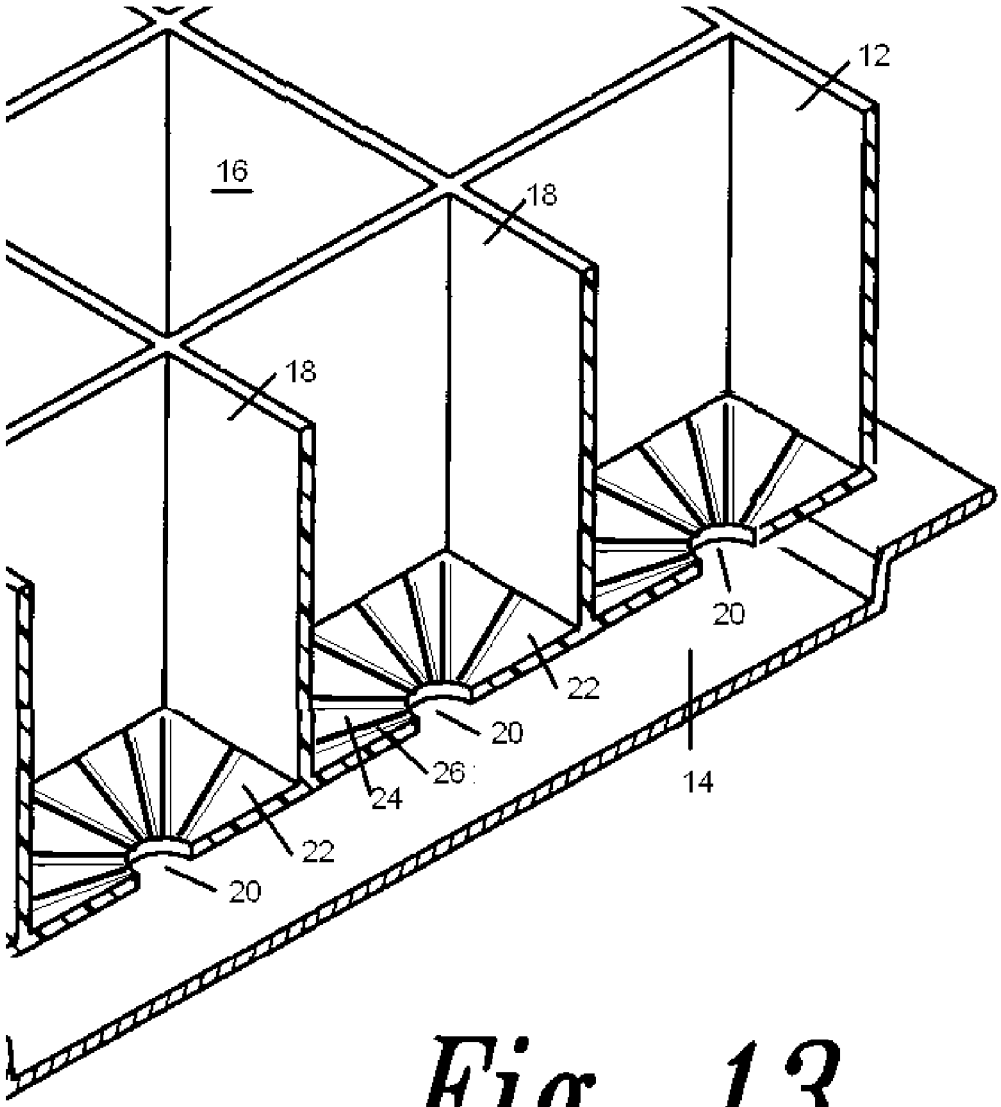
FIG. 13 is perspective cut-away view of a compartment bottom showing a plurality of channels adapted to direct exudates drain to a center drain hole.

The portable and lightweight serving tray 10 of the present invention, without complexity of a heating or a cooling element, comprises a food carrier 12 uncovered by any other serving tray component and removabley engaged with a collecting tray 14 cooperating to prevent relative movement between them during use. The collector 14 is wholly under the food carrier 12 but for an outwardly-extending ledge 34 raised above a collector bottom 13 on collector sides 11 substantially about the collector 14 and amenable for use as a handle 36 in lifiting the collector 14 and the food carrier 12 thereon. The food carrier 12 has a plurality of open-topped, or uncovered, adjacent compartments 16 each comprising upstanding side walls 18 circumferentially defining said compartment 16 with a wall rigidity suitable for supporting foodstuffs 100 loosely placed therein. Each compartment 16 has at least one drain hole 20 in a and substantially flat horizontal compartment bottom 22. The upstanding, substantially vertical walls and substantially flat horizontal bottoms are mutually integral to the food carrier, the integral whole of the food carrier being separable as a whole from the collector. For these purposes, the term "integral" is deemed to mean that food carrier walls and bottom are in separable, forming the whole of the food carrier. The drain hole 20 provides fluid communication between the food carrier 12 and the collecting tray 14 through which exudates from said foodstuffs 100 may drain from the respective compartments 16 to the collecting tray 14 beneath as a common basin into which all compartments drain.

To facilitate drainage out of the compartments 16, the respective bottom 22 of each is slightly in funnel shape, or tapered from compartment side walls 18 to its drain hole or holes 20 therein keeping the respective compartment 16 free of pooling foodstuff exudants 102 in which the foodstuffs 100 might otherwise stand. In another embodiment, the compartment bottoms 22 are channeled with fluids draining through channel troughs 24 and food stuffs 100 are supported on channel ridges 26.

The side walls 18 are of length suitable to support elongate foodstuffs 100 set approximately vertically in said compartments 16 leaning on said walls 18 such that food liquids drain down and off the upstanding foodstuffs 100 to the compartment bottom 22 and out said at least one drain hole 20 without said liquids pooling in said compartments 16.

For tray efficiency, the compartments 16 are close-packed; that is, they share side walls 18 that divide adjacent compartments 16. Typically, the compartments 16 are configured in an array of close-pack rectangular open-top boxes in horizontal side-by-side disposition, each accessible to receive upstanding foodstuffs through its uncovered, open compartment top 28, presenting as a first set of parallel side walls 30 extending across the food carrier longitudinally orthogonally intersecting a second set of parallel side walls 32 extending across the food carrier transversely forming the plurality of rectangular compartments 16 in close-pack array.

In an alternative embodiment, the drain hole 20 comprises a plurality of holes in an array presenting a mostly open bottom formed of intersecting, or crisscrossing elongate members 38 forming a grid of holes 40 in a mesh of suitable size to supporting the foodstuffs 42 in the compartment 16 above the collecting tray 14.

The food carrier 12 releasably engages with the collector tray 14 through food carrier legs 42 extending downward into collecting tray recesses 44 within the fluid collecting tray 14 preventing the food carrier 12 from moving laterally on the fluid collecting tray 14, said legs 42 being below the compartments 16, extending from the food carrier 12 to a collector bottom 13 onto which food exudates drain.

What is claimed is:

1. A food serving tray comprising an unheated food carrier including a plurality of food compartments having respective upstanding, substantially vertical walls and substantially flat horizontal bottoms mutually integral to the food carrier adapted to separate foods placed in respective compartments, each compartment with at least one hole in its respective compartment bottom draining its compartment to a fluid collector therebeneath on which the food carrier rests, the integral whole of the food carrier being separable from the collector, each of the upstanding walls being of length to support elongate foodstuffs set approximately vertically in said compartments leaning on said walls such that food liquids drain down and off the upstanding foodstuffs to the compartment bottom and out said at least one drain hole without said liquids pooling in said compartments, the food carrier further comprising legs supporting the food carrier compartments above the collector, said legs being below the compartments, extending from the carrier to a collector bottom.

2. The tray of claim 1 wherein the food carrier releasably interconnects with the fluid collector preventing the food carrier from moving laterally on the fluid collector.

3. The tray of claim 1 wherein said legs releasably cooperatively engage collector recesses.

4. The tray of claim 1 in which said compartments remain open at their tops, uncovered by any part of the food serving tray for ease of receiving and removing foodstuffs during serving.

5. The tray of claim 1 wherein the food carrier compartments are close-packed with adjacent compartments divided by shared upstanding walls.

6. The tray of claim 1 wherein said bottoms are channeled with fluids draining through channel troughs and foodstuffs are supported on channel ridges.

7. The tray of claim 1 wherein the compartments are adjacent in horizontal side-by-side disposition with each compartment sharing a wall with its next adjacent compartment, each accessible to receive upstanding foodstuffs through an uncovered, open compartment top.

8. The tray of claim 1 wherein the compartments comprise an array of close-pack rectangular open-top boxes sharing side walls between adjacent compartments.

9. The tray of claim 8 comprising a first set of parallel side walls extending across the food carrier longitudinally orthogonally intersecting a second set of parallel side walls extending across the food carrier transversely forming said plurality of rectangular compartments in close-pack array.

10. The tray of claim 1 wherein the tray is portable and lightweight without complexity of a heating or a cooling element.

11. The tray of claim 1 wherein the compartments are all on a single horizontal level each accessible from its open top.

12. The tray of claim 1 wherein the collector comprises an outwardly-extending ledge substantially around the collector amenable for use as a handle in lifting the collector and the food carrier.

13. A fluid-collecting food serving tray comprising an uncovered food carrier removably engaged with a collector tray wholly under the food carrier but for an outwardly-extending ledge raised above a collector bottom on collector sides substantially about the collector and amenable for use as a handle in lifting the collector and the food carrier thereon and having a plurality of open-topped adjacent compartments in the food carrier uncovered by another food serving tray component therein being amenable for receiving and separating foodstuffs placed generally upstanding therein comprising upstanding side walls circumferentially defining a respective said compartment within, each compartment having at least one drain hole in a compartment bottom providing fluid communication between the food carrier and the collector tray through which fluids from said foodstuffs placed in the food carrier may drain from the respective compartments to the tray beneath, at least a portion of said adjacent compartments being close-packed in sharing upstanding side walls with substantially flat bottoms, the food carrier further comprising legs supporting the food carrier compartments above the collector, said legs being below the compartments, extending from the carrier to a collector bottom.

* * * * *